United States Patent [19]

Harris et al.

[11] 4,378,242

[45] Mar. 29, 1983

[54] VACUUM PURIFICATION OF LIQUID METAL

[76] Inventors: Ralph Harris, 371 Dulwich, St. Lambert, Quebec H2Z 2P4, Canada; William G. Davenport, 2036 E. 3rd St., Tucson, Ariz. 85719

[21] Appl. No.: 367,262

[22] Filed: Apr. 12, 1982

[30] Foreign Application Priority Data

Oct. 28, 1981 [CA] Canada ..... 388935

[51] Int. Cl.[3] ..... C21C 7/10

[52] U.S. Cl. ..... 75/49

[58] Field of Search ..... 75/49, 61

[56] References Cited

U.S. PATENT DOCUMENTS 3,239,204 3/1966 Hokanson ..... 75/49

3,798,025 3/1974 Ramachandran ..... 75/49

*Primary Examiner*—P. D. Rosenberg

*Attorney, Agent, or Firm*—Stevens, Davis, Miller & Mosher

[57] ABSTRACT

A bath of liquid steel containing metallic impurities is subjected to vacuum effective to cause emission from the bath surface of the metallic impurities as a bulk flow of rising gases. The surface of the bath is kept substantially free of surface contamination. The rising gases are disposed of to prevent reflux. The pressure is then returned to normal, and the treated steel recovered. Preferably, the chamber pressure is maintained at a level equivalent to 60% to 80% of the total vapor pressure of the liquid metal. Desirably, the liquid steel is lifted (for example, by using a gas), from a lower level in the bath to at least its surface to enhance circulation within the bath. Preferably the rising gases are condensed remote from the bath surface to prevent reflux. An apparatus suitable for treating molten metal to remove impurities includes a vacuum chamber enclosing a receptacle for a bath of molten metal, a gas outlet and an outlet for liquid condensate and vacuum pump means for applying a vacuum to the gas outlet. Two hollow legs lead downward from the bottom of the receptacle for immersion in a supply bath of molten metal. A condenser, above the liquid metal level in the receptacle, has surfaces for intercepting emitted gases and converting them to condensate. Means is provided for continuously injecting lifting gas into an up-leg to provide in it, upward circulation of metal and downward circulation in a down-leg. Preferably there is means at the top of up-leg for spraying liquid metal on the surface of the bath.

41 Claims, 10 Drawing Figures

VACUUM PURIFICATION OF LIQUID METAL

BACKGROUND OF THE INVENTION

1. Field of the Invention

This invention relates to refining steel containing residual metals as impurities and to apparatus for this purpose.

2. Description of the Prior Art

Today, steel scrap is widely used as feed stock for steelmaking. Scrap is derived from various sources and, unavoidably, contains other residual metals which, if not removed, reduce the quality of the product steel.

The standard refining processes using oxygen, for example the BOF and the QBOP processes, are effective in removing most of the impurities. However, they do not remove certain residual metals, particularly copper and tin. So steel made from low grade scrap, in which the copper content is above about 0.15% by weight, is poor in hot working properties because the copper goes into a liquid phase at the grain boundaries and cracks occur when the steel is hot worked.

A partial solution to this problem has been to select the scrap carefully from the more expensive grades to match the end use of the steel. So the steelmaker faces the dilemma of paying a higher price for higher grade scrap or of using a lower grade scrap and finding some way of eliminating the impurities.

One suggestion has been to remove metallic impurities from steel by treatment with a halide-containing compound. See, for example, U.S. Pat. No. 3,441,404. This type of process introduces safety and hygiene problems, and insofar as the applicant is aware, has not been used commercially.

There has also been some research done on removing residuals from molten steel by vacuum treatment. See, for example, Salomon-de Frieberg and Davenport, 'Vacuum Removal of Copper from Melted Steel Scrap', The Metallurgical Society of CIM, Annual Volume, 1977, and Harris and Davenport, 'Pilot Plant Scale Vacuum Distillation of Liquid Steel to Remove Copper', Canadian Metallurgical Quarterly, Volume 18, 1979. Both papers show that although copper could be removed from steel by vacuum treatment, the projected times of 90 to 240 minutes were too long for practical purposes. Apart from the cost factor of such a long treatment period, the superheat in the steel would decrease to below its liquidus temperature and make casting impossible. This coupled with inconsistency of the results reported in earlier work led to disenchantment with vacuum refining as a potential commercial means of upgrading steel from melted scrap containing more than tolerable amounts of metallic impurities, particularly copper.

Another use of vacuum is described in U.S. Pat. No. 4,227,922. This process treated solid scrap, e.g. at a temperature less than 1000 K. and indicates that the refining kinetics are slow and unacceptable in tonnage operation. The process does not eliminate tin which is dissolved in the scrap and does not eliminate copper to any great extent at all. There is no suggestion that the process is applicable to molten steel.

SUMMARY OF THE INVENTION

The applicants have now found that there is an elusive combination of inhibiting factors causing the removal of metallic impurities from liquid steel by vacuum treatment to take so long and to be plagued with inconsistencies. They have found that an effective method of maximizing metallic impurity removal, taking into consideration both the time factor and method and equipment economics, must not only provide for the maintenance of a bulk flow from the liquid steel, of evaporated vapor containing the impurities gases, by applying a vacuum at a certain level depending on the changing vapor pressure of the melt, but that this must be combined with the continuous freeing of the liquid metal surface of slag, and continuously isolating the rising impurity gases from the melt, for example, by condensing them for example on special condensing surfaces spaced from the metal surface and removing the condensate from the vacuum chamber.

Bulk flow of evaporated vapor, from the liquid metal surface to the condensing surfaces, differs in kind from diffusion of the evaporated vapor through the gas phase between the metal surface and the condensing surfaces. With bulk flow, there is a high mean velocity (several hundreds of meters a second) of evaporated vapor from the molten metal surface towards the condenser surfaces, which the applicants have observed, optically, as a directional stream leading towards the condenser surfaces. This contrasts with diffusion which takes place when the chamber pressure is greater than the melt vapor pressure, no directional (negligible net velocity) stream was observed, only a relatively stationary cloud of metal vapor.

The applicants also observed, not only that a bulk flow of vapor away from the liquid metal can be achieved by decreasing the pressure within the vacuum chamber, but that the onset of bulk flow corresponds to a chamber pressure equal to the melt surface vapor pressure, and decreasing chamber pressure further increases the velocity of this bulk flow and evaporation rate. The applicants have also observed that the evaporation rate reaches a maximum when chamber pressure is at a level of 60% to 80% of the total vapor pressure of the liquid steel and that operating within this range maximizes evaporation rate, while, at the same time, minimizes the expense of producing higher vacuum with the resultant wear and tear on the system.

Surprisingly, therefore, in face of prior art findings that vacuum treatment is too slow to be practical, through the use of the invention, a user is now able to obtain a substantially maximum refining rate for any given heat of steel and a practical treatment time of not more than about 20 to 30 minutes, or even less, where the required tolerance of impurities is lower.

With this treatment time, the temperature loss of liquid steel in a treatment ladle is kept within tolerable bounds, for example, a loss of 25° to 30° Kelvin per treatment. Therefore, for steel which is to be cast, a finishing temperature within the range of 1900 to 1925 K. is required. Accordingly, a pre-vacuum treatment temperature of 1940 to 1980 K. is needed with 1950 to 1960 K. preferred. Or, to put it another way, the temperature, after vacuum treatment, should be at least 80° to 100° of superheat, that is at least 80° to 100° K. above the liquidus temperature of the steel.

Previously, the requirements for reducing the refinement time were not properly understood, with the result that prior experimental methods were operated at a set level of vacuum, having no regard for the vapor pressure of the liquid metal.

A preferred procedure in accordance with the invention is then as follows. There is provided, together with means forming a vacuum chamber, and subject to the vacuum, a bath of molten steel contaminated by metallic impurities. A pressure is created and continuously maintained in the chamber for example (by the use of a vacuum pump), less than the equilibrium surface pressure of the contaminated liquid steel. At the same time, the bath is continuously purged to keep it substantially free of contaminating surface film and metal thereby to maintain the bulk flow of metallic impurity gas substantially at a maximum, metallic impurity gases are immediately conducted away from the surface of the metal and condensed remotely from the bath, to reduce recycling of metallic impurities substantially to a minimum. When the bath impurity content reaches the desired level, the chamber pressure is increased to ambient and the treated molten metal recovered.

The results of the process may be enhanced by greatly increasing the surface area of the molten metal subjected to vacuum by continuously gas-lifting the molten metal above the surface of the receptacle and releasing it in finely divided form, to fall through the atmosphere of reduced pressure and onto the surface of the molten metal.

The process may be carried out in apparatus which includes a receptacle for molten metal and means forming a vacuum chamber above the receptacle whereby the surface of the molten metal is subjected to vacuum. Means forms a gas outlet to the vacuum chamber. Vacuum pump means is provided for applying a vacuum to the gas outlet. A condenser is located within the vacuum chamber above the liquid metal level and has surfaces for intercepting condensible gases emitted from the molten metal and converting them to condensate. Means is provided for introducing gas into a lower part of the receptacle in quantities effective to cause circulation of the molten metal to keep the surface substantially free of contamination.

A preferred apparatus is a receptacle used in conjunction with a separate supply vessel containing a major amount of the molten metal to be treated. In this apparatus, two hollow legs lead down from the bottom of the receptacle beneath the surface of the supply bath of molten metal. Means is provided for continuously injecting gas into one leg to provide upward circulation of metal therein and downward circulation in the other leg. Desirably, the outlet of the up leg is at an elevation above the surface of the molten metal in the receptacle and there is means in the top of the up leg for releasing the liquid metal and spraying it on the surface of the metal in the receptacle. This may, for example, be a cap on the top of the up leg with a side outlet so that the metal is intercepted by the cap and diverted through the side outlet. Preferably also the means for receiving and removing liquid condensate includes a condensate outlet and a barometric leg connected to it. It is also desirable to provide means for heating the condenser.

A preferred condenser includes a series of plates provided with extensive vertical surfaces. Preferably the vertical surfaces are arranged radially at an angle to each other. In one construction, vertical plates each having a surface at a sharp upward angle to the surface of the molten metal and an edge extending diagonally downwards to conduct liquid flowing from the surface towards collection means.

The apparatus may be employed for refining other metals than steel.

The vacuum treatment is carried out on liquid steel once it has been formed and transferred into a ladle, to provide the bath, for example, immediately after BOF steelmaking, electric furnace melting or open hearth steelmaking, or, it is carried out on liquid steel which has been formed in one of the above mentioned processes after the steel is fully or partially killed and/or degassed.

Advantages are provided by carrying out the process before any ladle treatment such as desulphurization, argon stirring or alloying and also before casting. This is opposed to the vacuum degassing process (the predominant alternative use of vacuum) which is presently carried out after alloying and other ladle treatments.

The vacuum treatment may remove useful elements along with the impurities. One example is manganese. The removal of manganese during treatment is complete, that is, substantially 100% of the manganese initially present in the impure liquid is eliminated during treatment. Because almost all grades of steel require 0.1 to 1.0 wt % Mn, a subsequent addition of pure manganese or manganese alloy (typically ferromanganese) has to be made.

Another group of impurities eliminated during vacuum distillation are the dissolved gases. Depending on whether or not the steel has been unkilled, partially killed, of fully killed, oxygen, nitrogen and hydrogen or nitrogen and hydrogen or nitrogen and hydrogen, respectively, will be eliminated during the applicants vacuum treatment. This is of great advantage as these impurities are severely detrimental to the quality of many steels. It is thus within the ambit of the invention to combine the vacuum treatment with other steps in the steel refining process. The invention contemplates a series of refining steps in which the vacuum refining step precedes the alloying step, so that, in the latter, any elements, for example, manganese, which may have been removed, in the vacuum treatment, may be restored to the desired level.

A preferred procedure, according to the invention employs an apparatus including a ladle, in conjunction with a condenser, provided with extensive gas-condensing surfaces above the liquid metal surface and a gas exhaust passage, and means to bottom-inject inert or reactive gas into a body of liquid steel in the ladle.

Using this arrangement, a treatment run may proceed as follows:

1. The vacuum chamber is hot, having just completed a cycle, or having been preheated.
2. A ladle of impure liquid steel is positioned beneath the vacuum chamber;
3. The unit is lowered so that a gas tight seal is formed between the vacuum chamber and ladle;
4. The distillation unit is evacuated to a pressure less than the vapor pressure of the metal as calculated from the given equation (see below) and impure metal analysis. This is done by pumping gas from the vacuum chamber through the exhaust passage;
5. The liquid metal boils due to the evolution of residual dissolved gases;
6. A flow of inert gas is initiated and continuously injected through means in the ladle base;
7. A substantially uncontaminated area of surface is created on the liquid metal due to the metal flow created by the ensuing inert gas bubbles;
8. Reduced pressure inside the distillation unit is maintained by continued pumping;
9. Circulation of liquid metal occurs under the action of the inert gas which is present as entrained bubbles. As the bubble rises, the pressure decreases and some of the metallic impurities are gasified and entrained in the gas bubbles in the molten metal. At the top of liquid steel, the gases exposed to the vacuum expand violently, dispersing drops of liquid metal in finely divided form throughout a space provided above the bath. The finely divided metal and gas separates and the metal tumbles through the vacuum, to bombard the surface of the liquid metal;

10. After 10 to 30 minutes the metallic impurities will have been removed and gas injection is terminated. The exact duration of the treatment will depend on the impurity content of the starting steel.
11. The unit is repressurized to atmospheric pressure with a non-condensable gas, e.g., an inert or reducing gas or a mixture;
12. The vacuum chamber is raised so that it is clear of the ladle.
13. The ladle of purified metal is removed from beneath the vacuum chamber for further treatment or casting;
14. Vaporized impurities, which have been continuously collected on the condensing surfaces either as a liquid or a solid are recovered for further processing.

A practical amount of liquid steel processed in any one cycle may be in the range 5 to 350 tonnes, with preferred amounts of 50 to 200 tonnes per cycle.

A flow of non-condensable gas, comprising either inert gas (for example, argon or nitrogen), reducing gas (for example, carbon monoxide or hydrogen) or oxidizing gas (for example, oxygen or carbon dioxide) or a mixture of these may be injected at the bottom of the ladle at a flow rate in the range $10^{-5}$ to $10^{-1}$ $Nm^3$ gas per tonne of metal treated per minute (preferably $10^{-3}$ to $10^{-2}$ $Nm^3$ gas per tonne of metal treated per minute).

Injection of lifting gas causes circulation of liquid metal in the ladle, up to the surface in the direction of the rising bubles, across the surface, and down into the ladle again. This circulation creates an uncontaminated liquid metal surface, surrounded at the edges by slag which has been swept aside.

The circulation also causes thorough mixing of the purified metal from the surface with meal in the ladle, reaching all zones in the ladle, thereby rapidly lowering the concentration of impurities in the main body of liquid metal in the ladle.

Evaporating metal vapors, including those of the impurity metals and some iron vapor, mix with the injected lifting gas and are separated from them by the condenser. The condenser should have sufficient surface area to capture all the metal vapor evolving from the liquid metal, for example, a surface area within the range from 0.1 to 0.5 $m^2$ per tonne of metal treated. A preferred surface area is 0.2 to 0.3 $m^2$ per tonne of metal treated, having regard both to efficiency of vapor recovery and space limitations.

The coordination of chamber pressures and temperatures required to achieve rapid vacuum distillation are specified in following table of coefficients and by the equation:

Chamber pressure less than $A+B.\text{wt\%}\ Cu+C.\text{wt\%}\ Sn+D.\text{wt\%}\ Mn$.

| T (K.) | A | B | C | D |
|---|---|---|---|---|
| 1600 | 0.10 | 0.223 | 0.046 | 4.11 |
| 1700 | 0.49 | 0.913 | 0.173 | 11.7 |
| 1800 | 2.02 | 3.18 | 0.554 | 29.3 |
| 1900 | 7.12 | 9.70 | 1.57 | 66.2 |

-continued

| T (K.) | A | B | C | D |
|---|---|---|---|---|
| 2000 | 22.0 | 26.3 | 4.03 | 137 |
| 2100 | 60.9 | 64.9 | 9.42 | 262 |

The manner in which the table is utilized is demonstrated by the following typical example: A steel which is to be treated has, for example, a composition: 0.5 wt % Cu, 0.25 wt % Sn, 0.6 wt % Mn, various small quantities of a few other elements, for example 0.1 wt% C, with the bulk of the liquid being molten iron. The temperature used to select the coefficients from the table is that of the liquid metal, for example, 2000 K. The coefficients for copper, tin and manganese, B, C and D respectively are chosen, multiplied by the weight percent of copper, tin and manganese respectively and added to coefficient A to yield a value below which chamber pressure needs to be to ensure a maximum rate of impurity elimination, i.e.: chamber pressure less than $0.5\times26.3+0.25\times4.03+0.6\times137+22.0$.

The applicants prefer to select a chamber pressure from 60% to 80% of the vapor pressure of the liquid metal. This pressure is effective in creating a bulk flow of the evaporating vapor at the same time not requiring a lower pressure than necessary to eliminate the residual metals, in deference to economy of plant and equipment.

The applicants contemplate a process involving a number of successive heats, say from 3 to 40 heats a day, in which there are treated respectively steel of different compositions and/or temperatures, some of which have higher vapor pressures than others. In contrast to working at a fixed vacuum geared to the vacuum requirements of the steel with the lowest vapor pressure, a total amount of vacuum used over the entire set of heats may be substantially less. Economies in plant and operation may be effected in this manner.

BRIEF DESCRIPTION OF THE DRAWINGS

Having thus generally described the invention, it will be referred to in more detail by reference to the accompanying drawings, which illustrate preferred embodiments, and in which.

DESCRIPTION OF THE PREFERRED EMBODIMENTS

Figure 1:
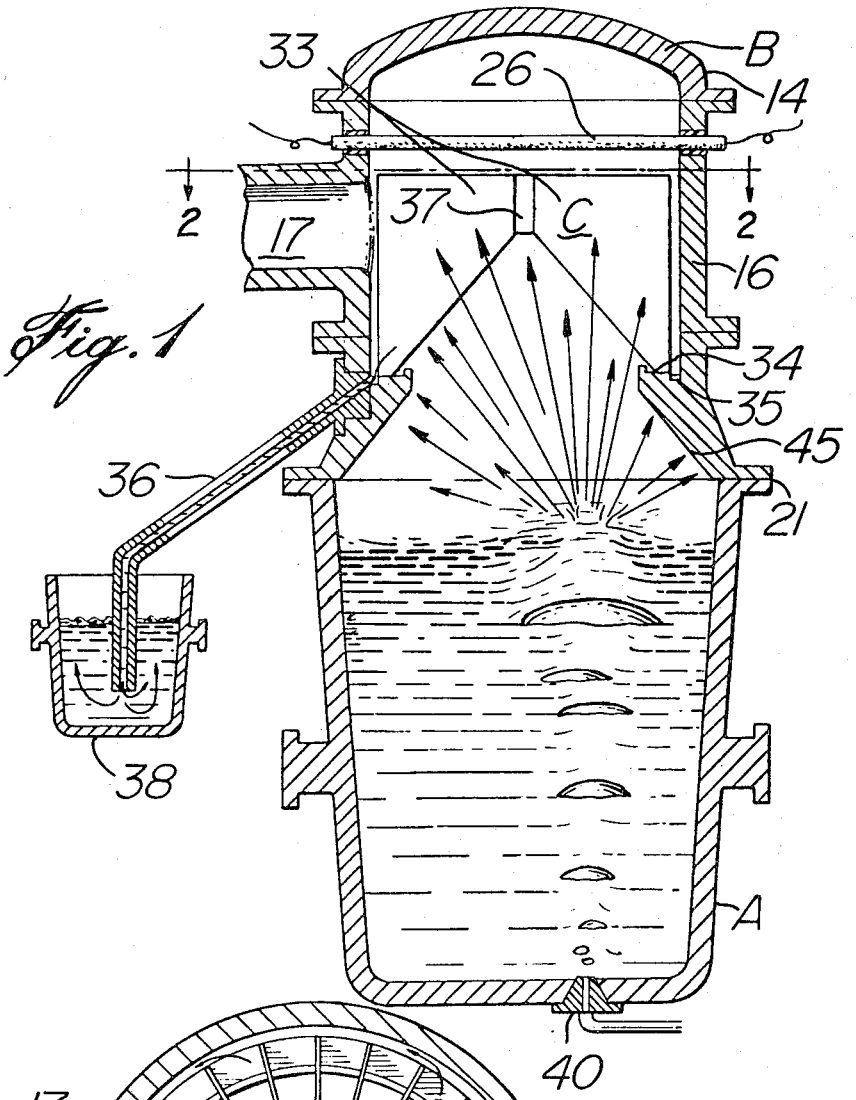
FIG. 1 is a vertical cross-section through a vacuum treatment apparatus according to the invention.

Referring to FIG. 1, A designates a refractory lined ladle. B identifies a vacuum chamber as a whole. The unit B includes a conduit 17 leading to a vacuum pump (not shown). The vacuum chamber B has a refractory lined steel shell 14 and mates to ladle A via a vacuum tight seal 21. The unit B includes a removably connected hood 16.

A vapor condensing arrangement C, made up of a number of plates 33 having extensive surfaces, is located in the chamber 15. The plates 33 have feet 34 resting in a condensate collection trough 35. At their upper ends, the plates abut to form a central joint 37. The condensate trough 35 extends right around the Chamber B and leads to a barometric leg 36 at one side of Chamber B. The leg 36 leads to a collection vessel 38.

In the hood 16 is mounted an electrical resistance heating element 26 for heating the plates 33, connected to a power supply (not shown).

Ladle A is equipped with a porous plug 40 for introducing gas into the liquid metal and is connected to a supply of non-condensible gas (not shown).

In general operation, ladle A is filled with molten steel and the vacuum chamber B positioned so that a vacuum tight seal 21 is formed between the ladle A and the vacuum chamber B.

Vacuum is applied to the vacuum chamber B and the liquid metal boils due to the evolution of residual dissolved gases. Sufficient free board 45 is provided so that the boiling liquid metal does not splash onto the condenser plates 33 or flow into the collection trough 35.

Mixing gas is passed through the porous plug 40 creating bubbles in the liquid which rise upward lifting with them liquid metal. A circulation of liquid metal thereby results with liquid metal rising with bubbles to the surface, flowing across the surface and back into the bulk of the liquid. At the same time, drops of liquid metal are ejected into the chamber space above the liquid metal by the explosive nature of the bursting bubbles and fall back into the ladle. The explosive release of gas from the bubbles plus the circulation of the liquid metal results in a clean surface for evaporation.

Metallic vapours evolve from this surface and also the droplets as they pass through the vacuum chamber space. As chamber pressure has been reduced to a level at which bulk flow occurs, there exists a directional bulk flow of evaporating vapour from all evaporating surfaces to condenser surfaces 33.

The condensable gas (gasified metals) strikes the surfaces of the plates 33 and is condensed to a liquid which the non-condensable gases are separated therefrom and withdrawn through the conduit 17 by the vacuum pump.

The liquid from the surfaces 33 flow to the receiving trough 35 and are led therefrom through the barometric leg 36 to the collecting vessel, 38.

More specifically, what takes place is as follows. The inert gas is entrained in the metal at the bottom of the ladle A in the form of bubbles at the hydrostatic pressure of the metal at the bottom of the ladle. As the metal rises in the ladle under the influence of the bubbles, it is subjected to reducing pressures, until it reaches the top of the ladle A where the pressure reaches vacuum proportions. The lifting gas and the gas from the evaporation of volatile species expands violently, dispersing some of the liquid metal into the chamber space. Thus, there results an explosive mixture of molten metal, inert gas and gasified volatile metals. After the bubble explodes, the non-condensable gaseous content of this mixture separates from the metal and leaves via the outlet, 17.

For achieving commercial results, a number of criteria must be coordinated. For example, the pressure in the vacuum chamber 15 should be maintained so that the emission of the volatile metallic gases is substantially at a maximum. See the equation explained above. The temperature of the plates, 33, must be maintained within a range low enough to condense the metallic gases as liquid and yet high enough to prevent its freezing, so that the volatile metals removed from the steel flows, as liquid, from the condensing surfaces into the collecting trough and is removed from the vacuum treating zone. It may be necessary to raise the temperature of the plates 33, since they would tend to lose heat through radiation to the roof and walls of the chamber 15. This may be done by actuating the heater 26.

The temperature of the condenser for a given run is determined by the composition of the metallic impurity vapors from the steel. The temperature for a given run can be set to suit the particular vapors. The temperatures during a given run can also be varied to compensate for change in vapor composition.

The flow of the inert gas through the porous plug, 40 must be kept within a range effective to provide substantially maximum circulation of liquid in the ladle A. The mixing action of the gas is caused by the injected gas bubbles lifting with them approximately 0.5 times their apparent mass as they rise. The mass of liquid lifted at any one time is approximately $0.5 \times V_B \times \rho_{steel}$ where $V_B$ is the total volume of bubbles in the liquid and $\rho_{steel}$ the density of liquid steel.

Figure 2:
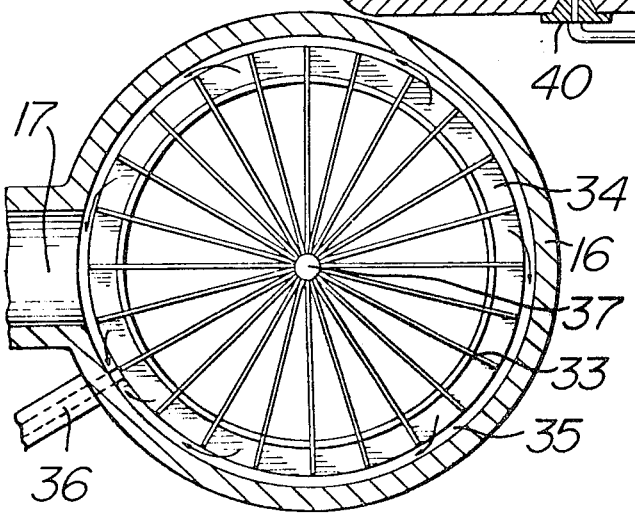
FIG. 2 is a horizontal cross-section along the line 2—2 of FIG. 1.
Figure 3:
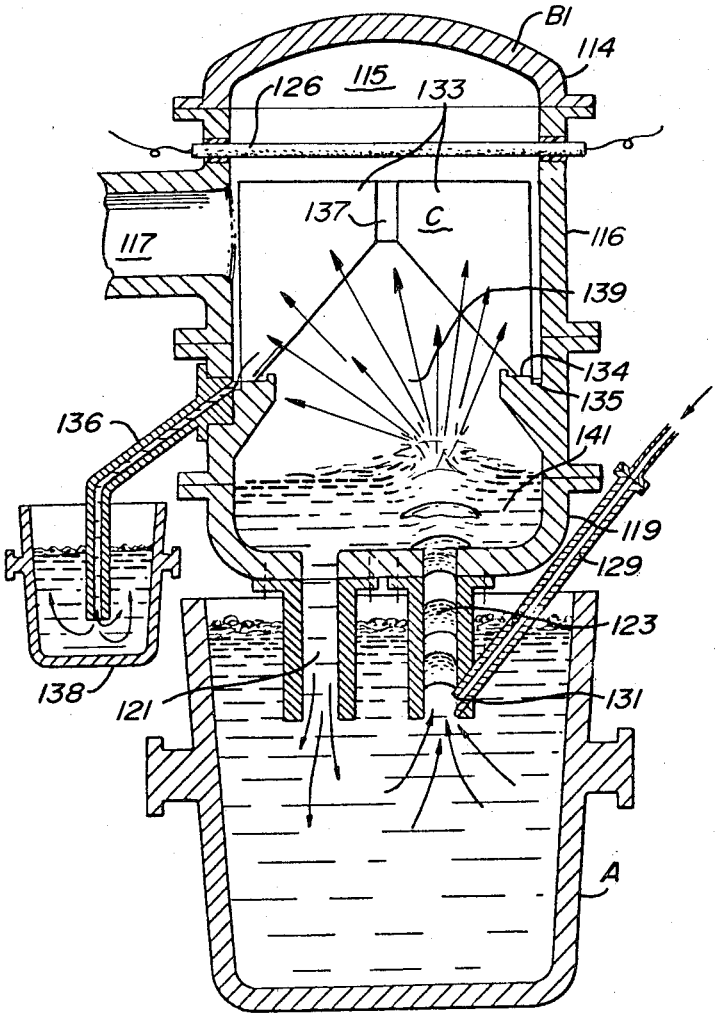
FIG. 3 is a vertical cross-section through a vacuum treatment apparatus according to the invention in which liquid steel is circulated through a receptacle incorporated into the vacuum chamber via two hollow conduits.

FIG. 3 shows an alternative unit, according to the invention. To avoid repetition, in describing this unit, the reference numerals have been given the same 10's and digits as reference numerals applied to corresponding parts in FIGS. 1 and 2, with the numerals as a whole having been raised by 100. The reference letters identify the same features as in FIGS. 1 and 2, but contain the subscript '1'. This scheme of reference numerals has also been followed in describing the units of the following figures.

The general arrangement of the refractory lined ladle $A_1$, the vacuum unit $B_1$, and the vapor condensing arrangement $C_1$ is essentially the same as the unit of FIGS. 1 and 2. However, the structure of the unit departs from FIGS. 1 and 2 as follows.

Two hollow legs or conduits 121 and 123 lead from below the surface of the metal in the ladle A, to the bottom of the receptacle 119. The legs 121 and 123 are of refractory material, for example, alumina, silicon nitride or stabilized zirconia. A lance 129 leads from a source (not shown) of lifting gas to a bottom part of the leg 123 where it terminates in an inlet or nozzle 131.

The nozzle 131 is preferably designed to produce large bubbles to create plug flow within the conduit 123. Plug flow is the condition created by a series of spaced-apart bubbles, which each occupy the entire cross-section of the up-leg 123. To this end, the nozzle should have an orifice Reynolds number less than 500. In the event of injecting a reactive gas, the nozzle 131 may be provided with protective means against thermal and chemical degradation. For example, it may have means for simultaneously injecting cooling or endothermic shrouding gas annularly about a main nozzle.

In general operation, the ladle A, is filled with molten steel, and the vacuum unit B, arranged so that the legs 121 and 123 are immersed below the surface of the metal in the ladle A. Vacuum is applied to the vacuum chamber B, and the molten metal is drawn up through the legs 121 and 123 till it reaches equilibrium and finds it level in the receptacle 119 to form a bath 141 having an extensive surface as compared to its depth.

Then, lifting gas is passed through the conduit 129 so that it rises through the leg 123, lifting with it molten metal from the ladle A. At the same time, the reduced pressure in the chamber B, causes vaporization of impurities from the molten metal bath and from the spray of droplets which are ejected from the bath surface when the bubbles break through because, under the vacuum in chamber 15, the gases expand violently. This violent expansion as well as the circulation of liquid metal due to the rising bubbles act on the bath surface in such a way to keep it free of surface film. The lifting gas and gasified impurities separate from the bath and flow towards the outlet 117. The condensable gases (metallic impurities) are intercepted by the condensing surfaces 133 on which they condense as liquid. The non-condensable lifting gas flows out through the exhaust passage 117.

The liquid from the surfaces 133 runs to the receiving trough 135 and is led therefrom through the barometric leg 136 to the collecting vessel 138.

More specifically, what takes place is as follows.

The inert gas is entrained in the metal at the bottom of the leg 123 in the form of bubbles, at the hydrostatic pressure of the metal at the bottom of the leg 123. As the metal rises in the leg 123, under the influence of the gas, it is subjected to reducing pressures, until it reaches the top of the bath 141 where the pressure reaches vacuum proportions. The lifting gas and the gas from the evaporation of volatile species expands violently, dispersing some of the liquid metal as droplets within the chamber space 39. The flow of the inert gas into the leg 123 must be kept within a range effective to provide substantially maximum circulation of liquid between the ladle A, and the receptacle 119. The length of the legs 121 and 123 must be within a range effective to immerse their lower extremities in the path in the ladle A, beneath the slag surface and to allow adjustment of the level of the surface of the metal in the vessel 119.

The lifting action of the gas is caused by the injected gas bubbles mixing with liquid metal in the conduit thereby lowering its average density by a factor f ($=1-V_B/V_C$ where $V_B$ is the volume of gas in the conduit at any one time and $V_C$ is the internal volume of the conduit) which in turn lifts the metal A height factor $h(=l_c[1/f-1]$ where $l_c$ is the length of the lifting conduit).

As can be seen, the dispersion of bubbles within the conduit does not affect lift. However, their dispersion does affect mass flow rate through the conduit. There are two extreme cases of dispersion: (a) fine dispersion, that is, uniform gas concentration along length of conduit, or (b) plug flow.

Plug flow i.e. where, the bubbles are large enough to bridge the diameter of the leg gives the highest mass flow rates. That is fortuitous because gas bubbles can be quite large in liquid metals, giving rise to plug flow. To this end, the injection lance should have a nozzle with an orifice Reynolds number ($N_{ReO}$) less than 500, (where $N_{ReO}=d_o u_g \rho_e/u_g'$ where $d_o'$ $u_g \rho_e$ and $u_g$ are orifice diameter, gas velocity at the orifice, liquid metal density and gas viscosity, respectively).

Figure 4:
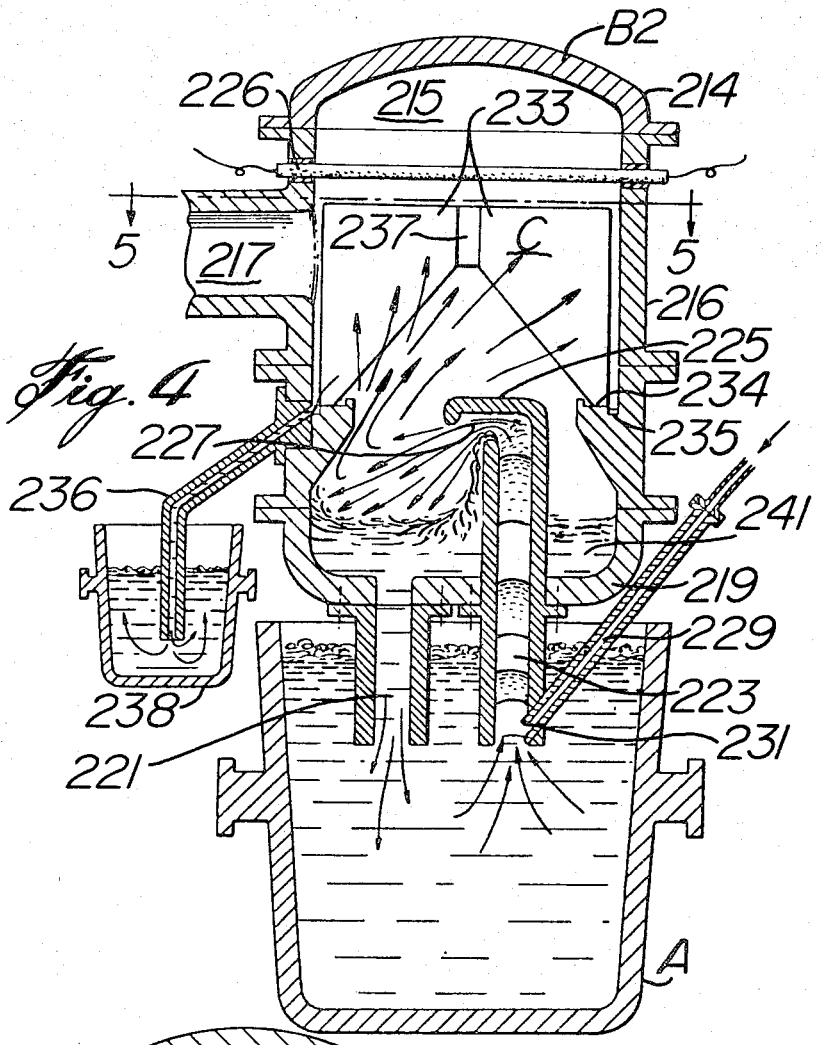
FIG. 4 is a vertical cross-section through a vacuum treatment apparatus according to the invention in which liquid steel is lifted above the level of a bath in a receptacle incorporated into a vacuum chamber via a hollow conduit having an overlying hood which directs the flow of a lifted steel onto the bath surface.
Figure 5:
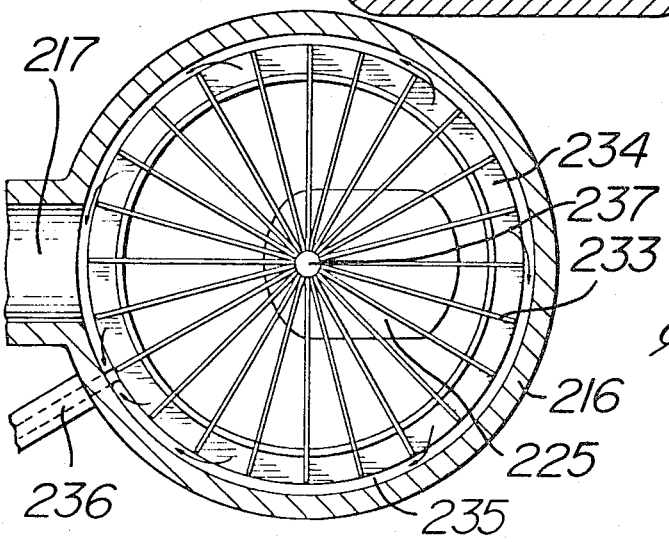
FIG. 5 is a horizontal cross-section along the line 5—5 of FIG. 4.

FIGS. 4 and 5 show still another form of unit according to the invention. This unit is similar to the unit of FIG. 3 and similar reference numerals have been applied to similar parts but raised by 100. The reference letters have been given the subscript '2', as compared with the description of FIG. 3.

In this form of unit the second hollow leg 223 leads from below the level of the liquid metal in the ladle $A_2$ to well above the level of the metal in the receptacle 219 and terminates in the gooseneck part of hood 225 having an outlet 227 above the surface of the molten metal.

The operation is similar to that of the unit of FIG. 3. However, the molten metal is lifted by the lifting gas to well above the level of the molten metal in the receptacle 219. As the molten metal passes through the gooseneck part 225, its path is inverted, and it is released in finely divided form through the outlet 227. The gases separate and behave as described in conjunction with the unit of previous figures. The lifting gas and the gas from the distillation of metallic impurities expands violently, dispersing the liquid metal within the gooseneck 225. The resulting explosive mixture of molten metal, inert gas and gasified volatile metals is inverted by the gooseneck 225 and the mixture expelled downwards, so that the metal is sprayed from the outlet 227 in finely dispersed form of streams and drops and bombards the surface of the molten metal bath 241 in the receptacle 219 keeping it free of surface film. At the same time, the gaseous content of flow in leg 223 separates from the metal and leaves the outlet 227 whence it rises upward. The condensable gases behave as with the arrangements previously described.

Placing the outlet 227 sufficiently far above the level of the surface of the moltem metal in the receptacle 219 provides a fall to the molten metal surface effective to furnish good evaporation from the falling metal droplets and leave should be taken to place the condensing surfaces 233 as close as possible to the molten metal surface without being close enough to be splashed, as with the unit of FIG. 3, plug flow through the leg 231 is desirable.

Figure 6:
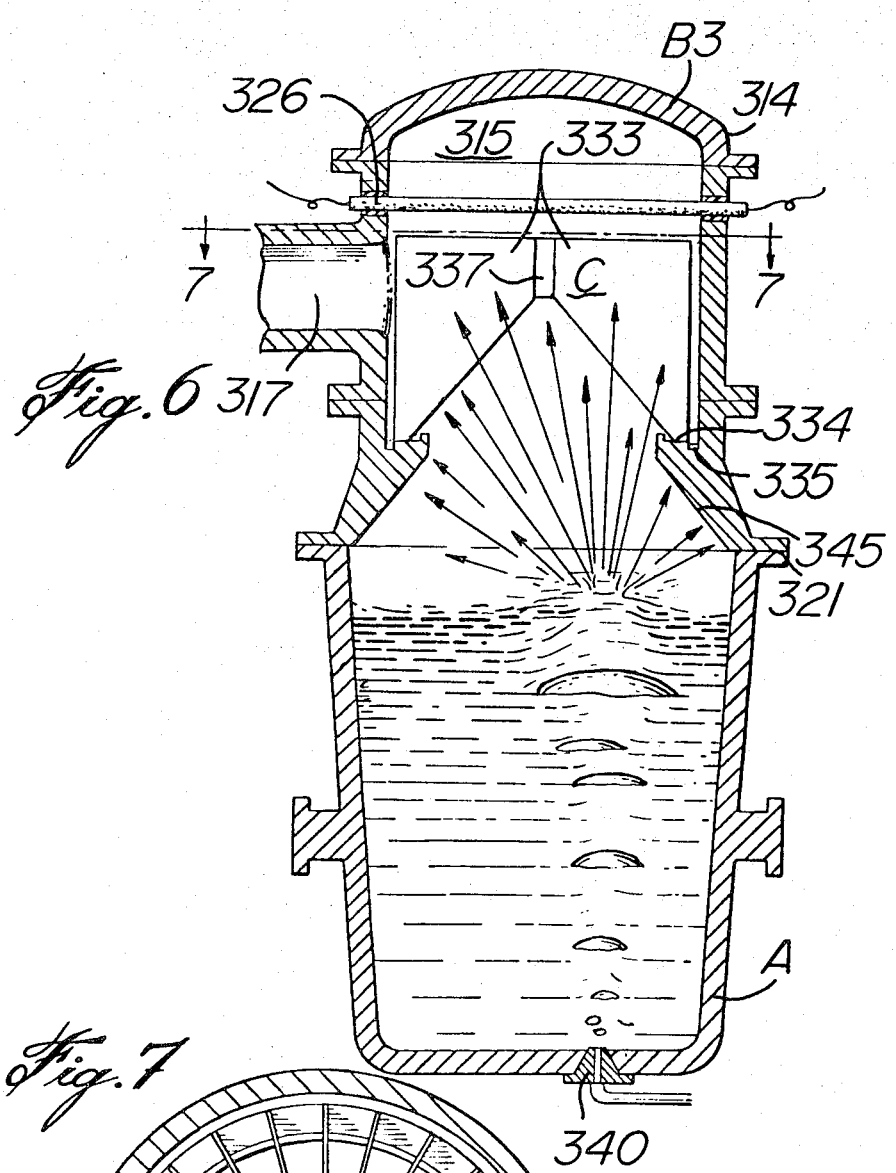
FIG. 6 is a vertical section through a vacuum treatment apparatus according to the invention in which gasified metal impurities are collected as a solid.
Figure 7:
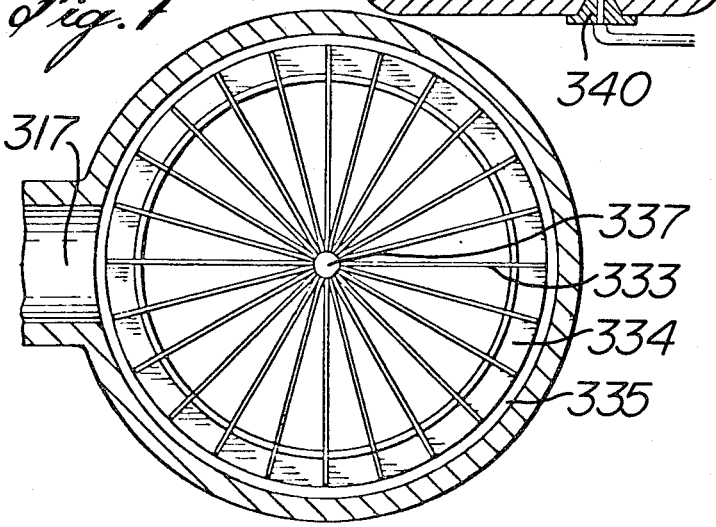
FIG. 7 is a horizontal section along the line 7—7 of FIG. 6.
Figure 8:
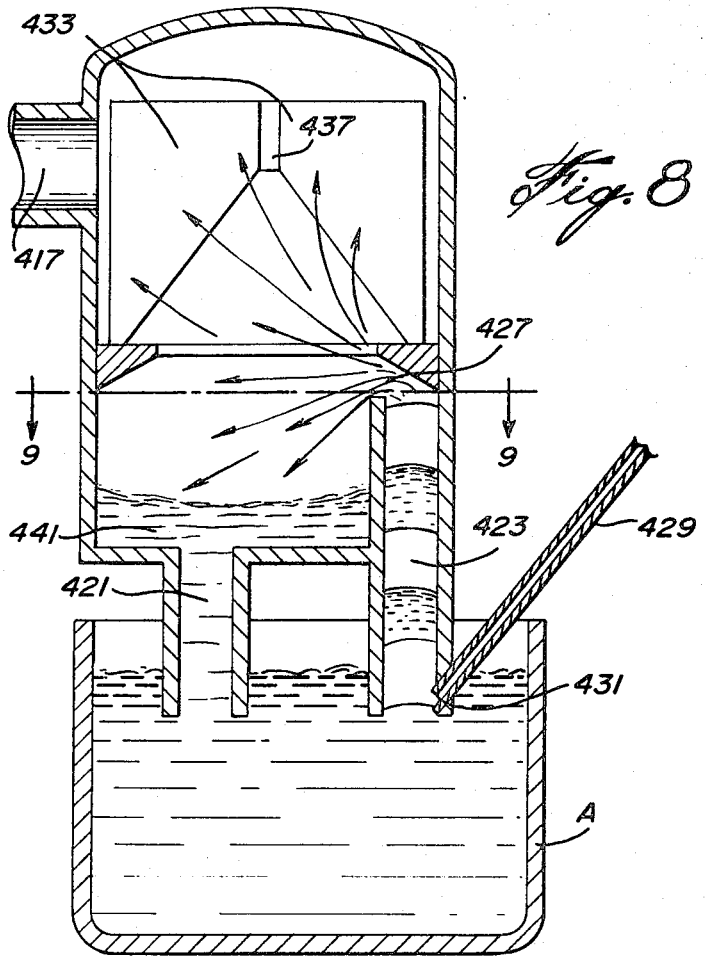
FIG. 8 through 11 show alternative apparatus, according to the invention.
Figure 9:
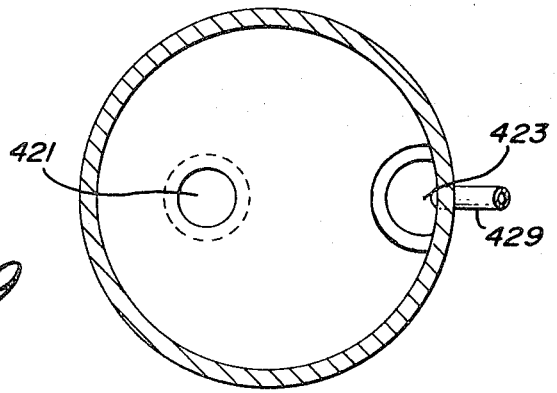
Figure 10:
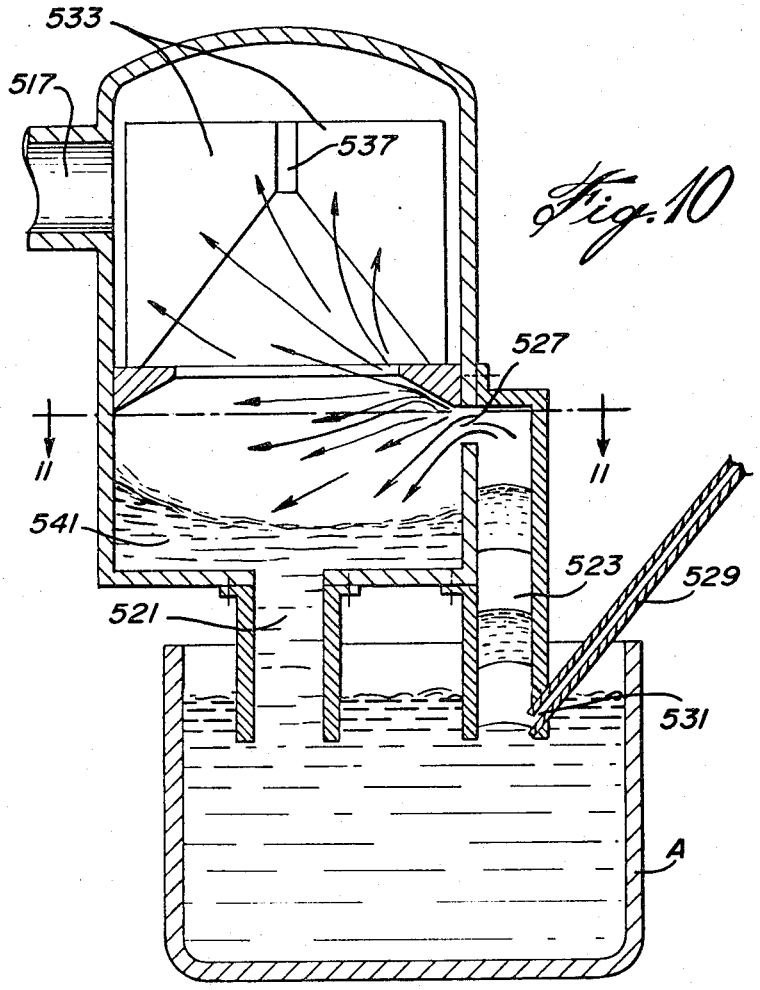
Figure 11:
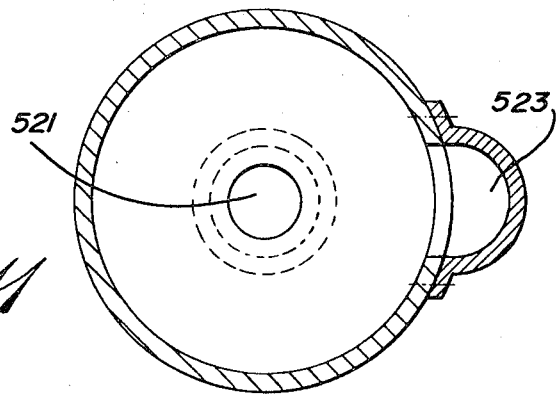

FIGS. 6 and 7 illustrate a unit similar to FIGS. 1 and 2, but in this case, the metallic vapors are condensed to a solid and therefore the barometric leg 36 and the collecting vessel 38 are omitted. The operation is similar to that of the unit of FIGS. 6 and 7 with the exception of that the condensate is collected and disposed of as a solid, rather than a liquid.

When the condensable gas (gasified metals) strike the surfaces of the plates 333 and is condensed to a solid while the non-condensable gases are separated therefrom and withdrawn through the conduit 317 by the vacuum pump. The temperature of the plates, in this case, 333 must be maintained within a range low enough to condense the metallic gases as a solid and yet high enough to prevent too great a heat loss from the chamber. The solid condensate is recovered by removing the condenser plates 333 from the chamber and heating them to the condensate melting temperature in a furnace having a reducing atmosphere. The condenser itself may, however, be necessary to raise the temperature of the plates 333, since they would tend to lose heat through radiation to the roof and walls of the chamber 315. This may be done by actuating the heater 326. The flow of the intert gas through the porous plug, 340, must be kept within a range effective to provide substantially maximum circulation of liquid in the ladle A.

FIGS. 8 and 9, 10 and 11 illustrate in vertical and horizontal cross-section respectively still further forms of units according to the invention. Similar reference letters and numerals have been applied to the various parts except that the letters have been given a respective subscript 4 and 5 and the reference numerals are in the 400's and 500's. The arrangements of FIGS. 8 through 11 place the respective up-leg 423 and 523 in position where the sidewall of the vessel is employed as part of it and the leg is less exposed to temperature and other effects within the vacuum chamber.

The operation of the units of FIGS. 8 to 11 is similar to that of the previous Figures and can be readily gathered from the description of those Figures.

Variable Factors

The process of the invention is subject to variable factors which will be discussed as follows:

Starting Materials

The invention is particularly applicable to purification of steel containing metallic impurities. The material supplied to the melting operation prior to the distillation unit process comprises either steel scrap, liquid hot metal or other ferrous charge material. The scrap charge which is melted is usually in the range ISIS (Institute of Scrap Iron & Steel) Code No. 200-No. 271. The invention is specially useful with scrap having high impurity contents, for example ISIS Code Nos. 204, 205, 206, 209, 210, 211, 212, 213, 214, 215, 218, 224, 225, 260 and 264. These Codes are hereby incorporated by reference.

Prior means of coping with low-cost, high-residual scrap is to dilute it with high-cost, low-residual scrap. The process of the invention requires no such dilution to produce a high quality steel having residual levels less than 0.15% Cu and 0.10% Sn. Dilution before processing is not beneficial, as it lowers the vapor pressure of the vaporizing residuals.

Any alloy may be treated which contains a significant portion of iron in the range 20 to 100% (preferably 65 to 99.5% Fe).

Residual elements contained in the starting steel are any non-ferrous substances found in liquid or solid steel. Residual elements eliminated by the vacuum treating may be: Cd, Mg, Pb, Zn, Ca, Cr, Mn, C, P, S, H, N, O, As, Bi, Co, Cu, Sb and Sn. Residuals which are not affected are: Al, B, Ti, V, Zr, Si, Mo, Ni and V.

Generally speaking, the comparison of the starting material with that of the finished product will be as follows.

Range of Impurities Prior to Treatment
Copper>0.15 wt% (preferred 0.25 to 2.5%)
Tin>0.10 wt% (preferred 0.2 to 1.5%)
Range Impurities after Treatment
Copper: 0.001% to 0.15 wt% (preferred 0.05 to 0.15 wt%)
Tin: 0.001% to 0.10 wt% (preferred 0.03 to 0.10 wt%)
How Much Removed
0 to 100% elimination of initial residual element (preferred 75 to 90% elimination)
Ultimate Levels
Undetectable (preferred 0.01 to 0.001 wt%)
Other Reactants Injected
Various compounds of some elements have high vapor pressure (e.g. SnS) with the result that their removal is enhanced (see British Pat. No. 968,046, Wright, 1964.)

Condenser Temperature

There are two possible modes of condenser operation; One in which the gasified metallic vapours are condensed as liquid and the other in which it is condensed as solid. To this end, the temperature of the condenser controls in which mode the unit operates.

In the liquid condensing mode, the condenser temperature is in the range 1200 K. to 1600 K. depending on the composition of the condensing vapours. At the commencement of refining the condensate has a lower melting point because there is a higher proportion of impurities in the vapour condensing compared to the latter stages when the proportion of iron vapour condensing is greater.

In the solid condensing mode, the condenser temperature is in the range 1000 K. to 1400 K. adjusted so that at no time does the condensate liquify. As in the liquid condensing case, condenser temperature can increase throughout a treatment because the melting point of the condensate increases as the quantity of impurity decreases with respect to the amount of iron evaporating.

Liquid Metal Temperature

The liquid steel temperature throughout the distillation operation should be in the range 1800 K. to 2100 K. with a preferred temperature of 1875 to 2000 K. Increasing liquid steel temperature increases refining rate till 2150 K. is reached at which temperature the applicants have found that iron loss is so great to make any further temperature increase counter-productive.

The distillation unit shown has no facility for directly heating the liquid metal which circulates through it, therefore, the liquid metal has only the sensible heat it contains at the beginning of treatment plus any additional heat which may be supplied indirectly.

The temperature of the liquid metal is primarily determined by the tapping temperature of the prior operation less any temperature loss associated with the transfer of the ladle of liquid metal to beneath the distillation unit. Liquid metal temperature then continues to decrease (unless some corrective action is taken) due to further heat losses from both the ladle and distillation unit.

Liquid metal temperature fall may be arrested or reversed during treatment by indirectly supplying heat from the carbon-oxygen reaction, by either introducing an oxidant in the injected gas, which will react with carbon in the metal to produce heat, or by introducing both oxidant and fuel into the injected gas thereby producing heat without altering the liquid metal composition. For the purpose of minimizing heat losses, the unit may be maintained hot from cycle to cycle, if there is any appreciable delay between cycles, by plasma torch or oxyfuel burner in the legs.

In starting up, the entire unit should be preheated to operating temperature and the proper differential between the temperature of the gas coming off and the temperature of the condenser.

Time

The processing time may range from 10 to 30 minutes (preferred 15–20 minutes). Processing time is affected by (i) amount of refining desired: 0 to substantially 100% elimination of initial impurities (preferred, 75–90% elimination).
(ii) liquid metal temperature: 1800 K. to 2150 K. (preferred, 1850 K. to 2000 K.).
(iii) agitation: quiescent to violent turbulence (preferred, violent turbulence).
(iv) distillation unit interior pressure
(v) injected gas flow rate

Pressure

Distillation unit interior pressure varies from atmospheric, between cycles and when the unit is not in operation, to pressures which will normally be in the range from 5 to 10 pascals during treatment. The variation in pressure throughout the cycle is explained in the working example.

The chamber pressure should be reduced to the operating level as fast as possible. This increases the productivity of the process.

Mixing or Lifting Gas

The mixing or lifting gas may be any non-condensable gas comprising either pure gas or a mixture of gases where the gases may be either reactive or inert. Preferably, it is argon gas mixed with quantities of either oxidizing gases such as oxygen or carbon dioxide or reducing gases such as carbon monoxide or hydrocarbon gas. (Nitrogen could be used early in the process if cost is important).

Characteristics of the Bath of Molten Metal

A bath of molten metal within the distillation unit (i.e. above the legs) acts as a collector for the liquid metal which has been lifted via the up-leg and as a site for elimination of impurities leaving the surface directly.

The bath depth may be in the range 0.01 to 1.0 m (preferred 0.2 to 0.5 m). Bath surface area may range from 0.06 $m^2$ to 0.033 $m^2$ per tonne of metal treated. Bath volume in the range 0.006 $m^3$ to 0.033 $m^3$ per tonne of metal treated.

Condenser

The condenser leads evaporated volatile metal vapor away from the liquid metal surface by virtue of placing a sink for the metal vapor at a location remote from the liquid metal surface. The area of the condensing surface is large enough so that the liquid condensate forms either a liquid film which will adhere to and flow down the surface and into the condensate trough without dripping off the surface back into the molten metal or a solid mass which will not interfere with the flow of non-condensable gas to the outlet.

The condenser has sufficient surface area to capture 100% of the condensable gases evolving in the distillation unit. Its surface area is in the range 3 $m^2$ to 0.3 $m^2$ per tonne of metal treated (preferred 0.60 $m^2$ to 0.35 $m^2$ per tonne of metal treated.

Process Reactions

The reactions occuring during treatment is as follows:

In the case of an inert lifting gas: (i)

$$\text{impure metal} \xrightarrow[\text{distillation}]{\text{vacuum}} \text{purified metal} + \text{condensed impurities}$$

-continued

In the case of an oxidizing lifting gas: (ii)

$$\text{impure metal} \xrightarrow[\text{oxidation}]{\text{vacuum distillation}} \text{purified metal} + \text{condensed impurities}$$

In the case of a reducing lifting gas: (iii)

$$\text{impure metal} \xrightarrow[\text{reduction}]{\text{vacuum distillation}} \text{carburized purified metal} + \text{condensed impurities}$$

Agitation

Agitation contributes to creating a clean surface area on the metal in the receptacle for exposure to the action of the vacuum, increases the surface area exposed to vacuum, and increases the liquid phase mass transfer. All these factors increase the refining rate.

In the distillation unit, agitation is caused by the rise of the gas bubbles through the liquid metal and their breaking through the liquid metal/vacuum interface.

Materials of Construction

The distillation unit has a demountable vacuum tight steel casing which supports the inner refractory lining. The unit is designed to treat all grades of steel and iron alloys and therefore the lining material is resistant to both chemical and thermal degradation. The most common and readily available grades suitable for application in each area of the unit should be used having regard for the newer more expensive but more robust grades of refractories such as those manufactured from silicon nitride, zirconia or alumina based refractory ceramics.

Examples of Chamber Pressure

An example of the variation of chamber pressure required for each of a series of heats is as follows:

A typical series of heats has initial temperatures and copper, tin and manganese contents as shown in the table below:

| | Temp. | % Cu | % Sn | % Mn |
|---|---|---|---|---|
| Heat 1 | 1900 K. | 0.25 | 0.10 | 0.3 |
| Heat 2 | 1900 K. | 0.50 | 0.20 | 0.6 |
| Heat 3 | 2000 K. | 0.25 | 0.10 | 0.3 |
| Heat 4 | 2000 K. | 0.50 | 0.20 | 0.6 |

Using the given table of coefficients, the chamber pressure required at the start of the purification and that required at the finish (80% copper and tin elimination, 100% manganese elimination) are as specified in the following table:

| | Initial Chamber Pressure (pa) | Final Chamber Pressure (pa) |
|---|---|---|
| Heat 1 | 21 | 5.3 |
| Heat 2 | 36 | 5.7 |
| Heat 3 | 49 | 16 |
| Heat 4 | 83 | 17 |

In further illustration of the invention, the following example is provided of a typical production heat.

Example

A 150 tonne ladle is charged with molten steel having a measured temperature of 1950 to 2000 K. and minor element contents of 0.25% Cu, 0.2% Sn, 0.5% Mn, 0.05% S, 0.2% C and small quantities of various other residual elements commonly found in molten steel, oxygen and nitrogen, for example.

The ladle is positioned beneath a vacuum refining unit with an internal volume of 15 $m^3$ and a vacuum seal is made by immersing the legs of a unit, similar to that shown in the drawings, in the liquid steel.

Pumpdown is commenced at maximum rate by fully opening the vacuum chamber to the vacuum pumps.

In the case of the legged vacuum unit, liquid metal is drawn up into the vessel through the legs under the action of vacuum and external atmospheric pressure.

When the pressure in the chamber has decreased to 150 to 1500 pascals, due to pumping, dissolved gases evolve as bubbles causing violent stirring of the bath and a spray of metal droplets within the chamber.

As chamber pressure decreases further, the violent degassing subsides due to the exhaustion of the dissolved gases in the liquid steel.

A bulk flow of evaporating elements develops as chamber pressure reaches commencement operation pressure which in the case of this steel is 70 pascals.

A flow of non-condensible gas is initiated through the lance at the bottom of the upleg at a rate of 0.025 $m^3s^{-1}$. The non-condensible gas in this case is nitrogen for the first 70% of processing and argon for the remaining 30% of processing.

Injection of non-condensible gas causes violent agitation of the bath and explosive release of gas resulting in a spray of metal droplets within the chamber when the gas bubbles break through the bath surface.

Vacuum pumping continues at a rate in order to remove the injected gases from the chamber whilst maintaining the chamber pressure at a level of 70% of the vapour pressure of the liquid steel.

Solutes are eliminated from the bath, requiring the chamber pressure to be decreased accordingly. The rate at which chamber pressure is decreased is determined from previously measured rates of solute removal.

Gasifiable elements and non-condensible gas rise upward in a high velocity bulk flow away from the liquid steel surface towards a condenser located $m^2$ above the liquid steel surface.

The condenser, which includes a plurality of flat plates having a total vertical surface area of 37 m2 and an inner edge at an angle of 60 degrees to the horizontal, separates the non-condensible gases from the gasified elements by causing precipitation of the metallic vapours onto the vertical surfaces of the condenser.

The gasified elements precipitate onto the condenser, which is at a temperature of 1200 to 1600 K., as a liquid and form a film of fluid on the condenser surface which flows down into the collection trough.

The liquid precipitate flows around the trough to an outlet which drains via a barometric leg into a collection vessel outside the vacuum chamber.

The height of the legged vacuum chamber above the ladle is adjusted so that the internal bath depth is at all times only just sufficient to cover the base of the vacuum chamber interior.

During treatment, chamber pressure is decreased to maintain the 70% of liquid vapour pressure relationship until, either measured chamber pressure indicates that the purified steel meets specifications or a predetermined time has elapsed, usually in the range 15 to 25 minutes. The final pressure in this example for 80% elimination of copper and tin would be 16 pascals.

Gas injection is now terminated and pumping discontinued.

Argon is then fed into the vacuum chamber to repressurize it to atmospheric pressure.

Liquid metal flows back into the ladle in the legged vessel case.

The vacuum chamber and the ladle are separated and the ladle is removed for further treatment or casting.

During processing, the liquid metal temperature falls by 30 to 50 K. and condenser temperature rises from 1200 to 1600 K.

Approximately 1.7 tonnes of condensate are collected, having a composition of 18% Cu, 14% Sn, 45% Mn, 23% Fe.

The vacuum chamber is now ready for the next heat of liquid steel.

"Handbook, Institute of Scrap Iron and Steel Inc.", 1979, 1627 K Street, N.W., Washington, D.C. 20006.

We claim:

1. A process for removing metallic impurities from steel, comprising the steps of:
   - subjecting a bath of liquid steel containing metallic impurities, to vacuum effective to cause emission from the metal surface of the metallic impurities as a bulk flow of rising gases,
   - continually maintaining the surface of the molten metal substantially free of surface contamination to enhance the emission of the gases,
   - continually condensing the rising gases remotely from the surface of the bath to prevent reflux of the impurities into the molten metal thereby to increase the speed of removal of the impurities,
   - restoring the pressure to normal, and recovering the treated steel.

2. A process as defined in claim 1, in which the chamber pressure is continuously decreased, during treatment, such that it is maintained at a level equivalent to 60% to 80% of the total vapor pressure of the liquid metal to create and maintain a bulk flow of gasified vapors from the liquid metal surface to the condenser.

3. A process as defined in claim 1, including continuously lifting liquid steel from a lower level in the bath to at least the surface of the bath to create a circulation within the bath to maintain the surface of the bath free of contamination.

4. A process for removing metallic impurities from steel comprising the steps of:
   - subjecting a bath of liquid steel containing metallic impurities through a continuously decreasing pressure maintained at a level equivalent to about 60% to about 80% of the total vapor pressure of the liquid metal to create a bulk velocity of gasified vapors from the surface of the liquid metal,
   - continuously lifting liquid steel from a lower level in the bath to at least the surface of the bath to create a circulation within the bath to maintain the surface free of contamination,
   - continually condensing the rising gases remotely from the surface of the bath to prevent reflux of the impurities into the molten metal thereby to increase the speed of removal of the impurities, restoring the pressure to normal, and recovering the treated steel.

5. A process, as defined in claim 1, 3 or 4, in which the liquid steel is lifted by injecting a lifting gas into the bath.

6. A process, as defined in claim 3, in which a portion of the liquid steel is lifted above and dropped on the surface.

7. A process of removing metallic impurities from steel comrising the steps of:

subjecting a bath of liquid steel containing more than 0.15% by weight of copper and more than 0.10% by weight of tin to a continuously decreasing pressure maintained at a level equivalent to 60% to 80% of the total vapor pressure of the liquid metal to create a bulk velocity of rising gasified vapors from the liquid metal surface, continually maintaining the surface of the molten metal substantially free of surface contamination to enhance the emission of the gases, continually condensing the rising gases remotely from the surface of the bath to prevent reflux of the impurities into the molten metal, carrying on the steps for a time of not more than 30 minutes until the treated steel contains less than 20% of the initial copper and tin, restoring the pressure to normal, and recovering the treated steel.

8. A process, as defined in claim 1, in which gasified vapors are condensed to liquid remotely from the surface of the bath and removed as liquid to prevent reflux of impurities.

9. A process, as defined in claim 1, in which gasified vapors are condensed to solid remotely from the surface of the bath and maintained remote from the bath to prevent reflux of evaporated impurities.

10. A process, as defined in claim 1 or 8, in which the condensing is affected by a condenser having a number of substantially vertical plates arranged above the surface of the bath and having a total surface area within the range from about 0.1 to about 0.5 square meters per tonne of metal treated.

11. A process, as defined in claim 1 or 8, in which the condenser is made up of a number of substantially vertical plates arranged above the surface of the bath and having a total surface area within the range from about 0.2 to about 0.3 square meters per tonne of metal.

12. A process, as defined in claim 1, in which the steel is melted from scrap ranging from Code No. 200 to Code No. 271 of the Institute of Scrap Iron and Steel.

13. A process, as defined in claim 1, 2 or 3, in which the starting steel contains more than 0.15% by weight of copper and more than 0.10% by weight of tin, the process is carried on for a period of less than 30 minutes until the treated steel contains less than 20% by weight of the initial copper and tin.

14. A process, as defined in claim 2 or 3, in which there is employed a vacuum chamber containing a receptacle for the bath of molten steel and a vessel therebeneath containing a charge of liquid steel, a pair of conduits each having an end immersed in the molten steel in the vessel, one conduit connected to the receptacle below the surface level and the other leading to the vacuum chamber above the surface level, whereby there is a bath of liquid steel in the receptacle at a level in equilibrium with the charge of steel in the ladle, a lifting gas is continuously injected into one of the conduits whereby liquid steel is lifted therethrough into the receptacle to create a circulation of liquid metal between the vessel and receptacle.

15. A process, as defined in claim 1, 2 or 3, in which there is employed a vacuum chamber containing a receptacle for the bath of molten steel and a vessel therebeneath containing a charge of liquid steel, and a stream of liquid steel is continuously lifted from the vessel to above the surface of the liquid steel in the receptacle and dropped thereon and a compensating stream of liquid steel is drawn from a lower part of the receptacle and recycled to the vessel.

16. A process, as defined in claim 2, in which the lifting gas is injected at a rate in the range from about $10^{-5}$ to $10^{-1}$ $Nm^3$ per tonne of metal treated per minute.

17. A process, as defined in claim 1, 2 or 3, in which the starting steel contains more than 0.15% by weight of copper, the process is carried on for a period of less than 30 minutes and the treated steel contains less than 20% by weight of the starting copper.

18. A process, as defined in claim 1, 2 or 3, in which the starting steel contains more than 0.10% by weight of tin, and process is carried on for a period of less than 30 minutes and the treated steel contains less than 20% by weight of the starting copper and tin.

19. A process, as defined in claim 2 or 3, in which there is employed a vacuum chamber containing a receptacle for the bath of molten steel, a vessel containing a charge of liquid steel, a pair of conduits each having an end immersed in the molten steel in the vessel, one conduit connected to the receptacle below the surface level and the other leading to the vacuum chamber above the surface level, whereby there is a bath of liquid steel in the receptacle at a level in equilibrium with the charge of steel in the ladle, a lifting gas is continuously injected into the second conduit whereby liquid steel is lifted therethrough and discharged in finely divided form to drop on the surface of the molten metal in the receptacle.

20. A process for purifying steel containing metallic impurities, in which a series of heats is conducted on respective baths of liquid steel, comprising:

in advance of each heat, measuring the composition and temperature of the liquid steel bath and calculating the vapor pressure of the steel, during each heat, subjecting the bath to a vacuum of between 60% and 80% of the vapor pressure required to produce bulk flow and adjusting the vapor pressure continually to retain this relation as the impurities are eliminated, and removing the vacuum and recovering the treated steel whereby the maximum rate of refining is achieved in each heat and the total amount of vacuum employed over the entire series of heats is substantially less than the vacuum that would have been required by setting the vacuum to agree with the vapor pressure of the steel bath having the lowest vapor pressure.

21. A process, as defined in claim 20, in which the starting steel contains more than 0.15% by weight of copper, the process is carried on for a period of less than 30 minutes and the treated steel contains less than 20% by weight of the starting copper.

22. A process, as defined in claim 20 or 21, in which the starting steel contains more than 0.10% by weight of tin, the process is carried on for a period of less than 30 minutes and the treated steel contains less than 20% by weight of the starting copper and tin.

23. A process for producing steel comprising:

forming a bath of liquid steel from a steelmaking process containing residual metallic impurities and eliminable gases, subjecting a bath of such steel to vacuum treatment to remove metallic impurities and eliminable gases, recovering the vacuum-treated steel and then subjecting it to an addition, thermal, or chemical process, and directly casting the steel so treated.

24. A process for producing steel, comprising, forming a bath of liquid steel from a steelmaking process, containing residual metallic impurities including more than 0.15% by weight of copper, eliminable gases, and manganese, subjecting a bath of such steel to vacuum treatment to remove the metallic impurities and eliminable gases and the manganese, recovering the vacuum treated steel and then subjecting it to an addition process to add required constituents including manganese, and directly casting the steel so treated.

25. A process for removing metallic impurities from steel, comprising the steps of:

subjecting a bath of liquid steel containing metallic impurities including more than 0.15% copper to vacuum effective to cause emission from the metal surface of the metallic impurities as a bulk flow of rising gases, continually maintaining the surface of the molten metal substantially free of surface contamination to enhance the emission of gases, continually condensing the rising gases on condensing surfaces arranged remotely from the surface of the bath to prevent reflux of the impurities into the molten metal, continuously condensing the rising gases on said surfaces to prevent reflux of the impurities into the molten metal, continually adjusting the vacuum pressure to maintain it at a level equivalent to 60% to 80% of the total vapor pressure of the liquid metal thereby to maintain said bulk velocity if gasified vapor, adjusting the temperature of the condensing surfaces to maintain the liquidity of the condensed gases and continuously removing the liquid so formed on the surfaces to prevent return to the bath of molten metal.

26. An apparatus suitable for treating molten metal to remove impurities, comprising:

a vacuum chamber having a receptacle for molten metal, a gas outlet and an outlet for liquid condensate, vacuum pump means for applying a vacuum to the gas outlet, two hollow legs leading downward from the bottom of said receptacle for immersion in a supply bath of molten metal, a condenser above the liquid metal level in said receptacle having surfaces for intercepting gases emitted from the molten metal and converting them to liquid condensate, means for receiving liquid condensate from said condenser and removing it through said outlet, means for continuously injecting lifting gas into one leg to provide upward circulation of metal therein and downward circulation in the other leg.

27. An apparatus suitable for treating molten steel to remove impurities, comprising:

a vacuum chamber having a receptacle for molten metal, a gas outlet and an outlet for liquid condensate, vacuum pump means for applying a vacuum to the gas outlet, a first hollow leg leading downward from the bottom of said receptacle for immersion in a supply bath of molten metal, a second hollow leg extending from a position above the molten metal level in said receptacle to a position therebelow for immersion in said supply bath, means in the top of said second leg for releasing liquid metal and spraying it on the surface of the metal in said receptacle, a condenser above the liquid metal level in said receptacle having surfaces for intercepting gases emitted from the molten metal and converting them to liquid condensate, means for receiving liquid condensate from said condenser and removing it through said outlet, means for continuously injecting lifting gas into the second leg to provide upward circulation of metal therein and downward circulation in the first leg.

28. An apparatus, as defined in claim 26 or 27, in which the means for receiving and removing liquid condensate include a condensate outlet and a barometric leg connected thereto.

29. An apparatus, as defined in claim 26 or 27, in which there are means for heating the condenser.

30. An apparatus, as defined in claim 26 or 27, in which the condenser has a series of plates provided with extensive vertical surfaces located above the surface of the molten metal.

31. An apparatus, as defined in claim 26 or 27, in which there are a plurality of vertical surfaces arranged radially at an angle to each other.

32. In an apparatus of the type described, a condenser in which there are vertical plates each having a surface at a sharp upward angle to the surface of the molten metal and which has an edge extending diagonally downwards to conduct liquid flowing from said surface towards collection means.

33. An apparatus, as defined in claim 27, in which the second hollow leg is provided with inverting means in the form of a hood covering the outlet leg of the up-leg and projecting therebeyond to divert the flow of molten metal sideways and downwards onto the surface of the bath.

34. An apparatus for treating molten steel to remove impurities, comprising, means forming a vacuum chamber and a receptacle for molten metal, operatively connected said vacuum chamber having a gas outlet, vacuum pump means for applying a vacuum to the gas outlet, a condenser above the liquid metal level in said receptacle having surfaces for intercepting gases emitted from the molten metal and converting them to condensate, means for introducing gas into a lower part of the receptacle in quantities effective to cause circulation of the molten steel and to keep the surface free of contamination.

35. An apparatus, as defined in claim 26, in which the legs lead downward from the bottom of the receptacle in zones spaced from the vertical walls of the receptacle.

36. An apparatus, as defined in claim 26, in which one of said legs leads downward from the bottom of the receptacle spaced from the walls of the receptacle and the other leg is made up of a downward extension of one wall of the receptacle and a partition extending upwardly and downwardly from the bottom of the receptacle and spaced inward from said wall.

37. An apparatus, as defined in claim 26, in which one of said legs extends downward from the bottom of the receptacle at a zone spaced from the wall and the other leg is external to the receptacle and formed by part of the wall of the receptacle and a downward extension thereof and a separate wall outwardly spaced from said wall of the receptacle.

38. A process, as defined in claim 7, in which the treatment is carried out with steel at a temperature at least 80° to 100° K. above its liquidus temperature.

39. A process, as defined in claim 7, in which the pre-vacuum temperature of the steel is within the range from 1940° to 1980° K. and the heat loss during treatment is within the range from 25° to 35° C.

40. A process for removing metallic impurities from steel, comprising the steps of:

subjecting a bath of liquid steel containing metallic impurities, to vacuum effective to cause emission from the metal surface of the metallic impurities as a flow of rising gases, continually maintaining the surface of the molten metal substantially free of surface contamination continually preventing return of impurities into the molten metal, maintaining the vacuum, throughout the treatment, at a level at which the emission is in the form of a bulk flow of rising gases which in combination with the continual freeing of the surface of contamination and the continual prevention of return of the impurities reduces the time of removal of the impurities substantially to a minimum, restoring the pressure to normal, and recovering the treated steel.

41. A process for recovering metallic impurities from steel, comprising the steps of:

providing a body of liquid steel containing at least 0.15% by weight of copper and at least 0.1% by weight of tin at a temperature of at least 82° to 100° K. above its liquidus temperature and having an extensive free surface, subjecting said body to continuously decreasing pressure maintained at a level equivalent to 60% to 80% of the total vapor pressure of the liquid metal to create a bulk velocity of rising gasified vapors from the liquid metal surface, while continually maintaining the surface of the molten metal substantially free of surface contamination and continuously isolating the rising gases from the surface of the bath to prevent return of impurities to the molten metal, continuing the treatment until the treated steel contains less than 20% of the initial copper and tin, restoring the pressure to normal and recovering the treated steel.

* * * * *